US006862902B1

(12) United States Patent
Kim

(10) Patent No.: US 6,862,902 B1
(45) Date of Patent: Mar. 8, 2005

(54) DOUBLE SOCKS AND METHOD FOR PRODUCING THE SAME

(76) Inventor: Bong-Rak Kim, #609-30, Chang 2-Dong, Dobong-Gu, Seoul (KR), 132-042

( * ) Notice: Subject to any disclaimer, the term of this patent is extended or adjusted under 35 U.S.C. 154(b) by 0 days.

(21) Appl. No.: 10/941,372

(22) Filed: Sep. 15, 2004

(30) Foreign Application Priority Data

Jun. 16, 2004 (KR) ..... 10-2004-0044642

(51) Int. Cl.[7] ..... A41B 11/00
(52) U.S. Cl. ..... 66/178 R; 66/196
(58) Field of Search ..... 66/196, 169 R, 66/179–188; 2/239–242

(56) References Cited

U.S. PATENT DOCUMENTS 3,796,067 A * 3/1974 East ..... 66/178 R
4,467,626 A * 8/1984 Coble et al. ..... 66/196
4,615,188 A * 10/1986 Hursh et al. ..... 66/196
4,843,844 A * 7/1989 Hursh et al. ..... 66/196
4,958,507 A 9/1990 Allaire et al.
6,158,253 A 12/2000 Svoboda et al.
6,158,254 A * 12/2000 Richard ..... 66/179

* cited by examiner

*Primary Examiner*—Danny Worrell
(74) *Attorney, Agent, or Firm*—Darby & Darby

(57) ABSTRACT

The present invention relates to double-layered socks with inner and outer layers for warmth preservation and exercise. The double-layered socks according to the invention are formed by knitting the starting part (1) corresponding to the toe tip of the inner layer (10) at first, then the toe part (2), sole part (3), heel part (4) and ankle part (5) in that order, and then continuously knitting the ankle part (5'), heel part (4'), sole part (3'), toe part (2') and finishing part (1') belonging to the outer layer (20) in succession. Then, the inner layer (10) is arranged to be confronted with the outer layer (20) so as to knit the starting part (1) of the inner layer (10) together with the finishing part (1') of the outer layer (20) to join them. Finally, the inner and outer layers (10, 20) are sutured at the toe part (2') of the outer layer (20) to leave a single suturing line (7). Accordingly, the thickness of the suturing seams in the socks is remarkably reduced, so that the suppression or friction by the uppers of shoes on the toe areas of wearers can be removed when shoes together with such inventive socks are put on. The method for manufacturing the inventive socks is simpler and requires less labor and time compared to the conventional ones, whereby the production efficiency is raised.

2 Claims, 4 Drawing Sheets

DOUBLE SOCKS AND METHOD FOR PRODUCING THE SAME

Figure 1:
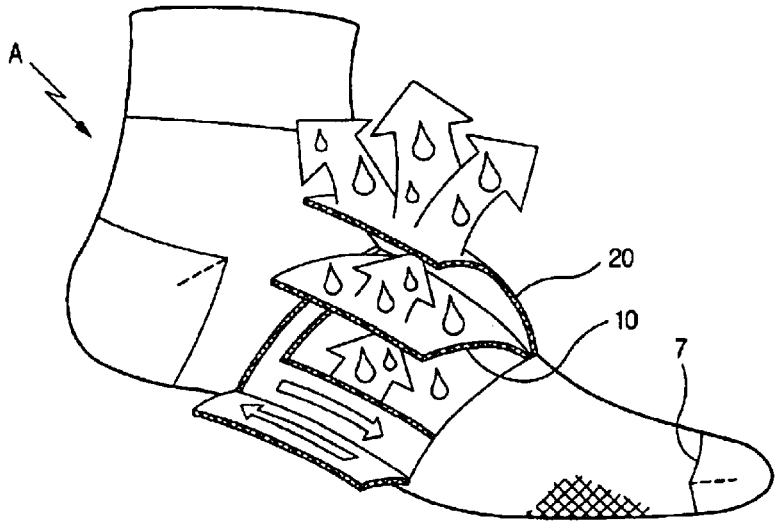

This application claims the benefit of Korean patent application No. 2004-0044642, filed Jun. 16, 2004, which is hereby incorporated by reference in its entirety.

FIELD OF THE INVENTION

The present invention relates to a double sock and a method for manufacturing the same and more specifically to double socks suited for exercise or for protection against the cold and a method of manufacturing such socks, wherein the comfortable wearing sense and simple manufacturing process are characteristic.

BACKGROUND OF THE INVENTION

Generally, men often put on several pairs of socks when putting on shoes in order to preserve the warmness in the cold winter or to prevent blister formation on the feet during an exercise including the mountain climbing and jogging.

Wearing several pairs of socks is troublesome and furthermore poor ventilation is apt to cause athlete's foot or bad smell after long hours. Incidentally, several sewed lines are overlapped at about the same positions, because the finishing suturing takes place at the toe parts of socks for most ordinary socks. As the result, the uppers of running shoes come in contact with the above-described suturing, when such shoes are put on during an exercise, for example, to increase the pressure on the toes. In the cases of severe exercise, the skins on the toe areas of the athletes are often peeled off due to the friction between the suturing of socks and the skins.

To remove such an inconvenience, in recent years, double socks which have the effect of two individual socks were developed and placed on the market. As a representative example of the double socks on the market, there are the kinds of double socks, which are formed by the steps of knitting two sheets of socks separately, putting one into the other sock and finally suturing the two socks either at the ankle positions or at other two or three positions. While this kinds of socks have the general advantage of the double socks, they have some flaws. That is, in case the toe parts of the inner and outer socks are not firmly joined by suturing, every movement of feet during walking or exercising does not lead to a synchronized movement of the inner and outer socks, or in some cases the inner socks get stuck between the toes, deteriorating the wearing feeling. In addition, the working procedure of inserting inner socks into outer socks and aligning the two sheets of socks with regard to every part of socks is complex and time-consuming to raise manhours or increase the manufacturing cost, let alone the unsanitary state of the finished product in use due to poor ventilation.

Another exemplar socks are produced by knitting two pieces of socks in succession, as in the ordinary case, putting the inner sock into the outer sock and subjecting the resulting one to the finishing step of suturing the toe parts of the two socks together in a manual or mechanical way. In this method, the suturing step is conducted at the outside of the outer sock and therefore there are chances of suturing only the toe part of the outer sock, leaving the toe part of the inner sock unsutured due to the mistake of the worker, causing the high rate of failed productions.

Furthermore, the sutured portions become rugged and thick, besides the difficulty of suturing, because the two junctures, i.e. one for the inner sock and one for the outer sock, should be sutured together simultaneously. Additionally, in the case of this type of socks, the thick sutured portions imposed the suppression on the toe area of feet, as in the case of wearing two separate pairs of socks, making wearing feeling uncomfortable and the appearance of the product also was untidy.

SUMMARY OF THE INVENTION

The object of the invention is to remove the drawbacks with the conventional socks while keeping the advantages as it was before, and so to provide double-layered socks wherein the sufficient material thickness provides heat conservation for the winter season and the comfortable wearing and particularly the front feet protection against blister even when hard exercising under the excellent sanitary ventilation can be ensured, mainly due to the easy, single and thinner suturing. The object includes provision of a method for manufacturing such socks, which is simple to save the time and labor and gives remarkably reduced chance of producing failed products.

The above-described object is achieved according to an aspect of the invention by a double sock with an inner and outer layers, each layer in its endless band form, the double sock being formed by knitting the starting part corresponding to the toe tip of the inner layer at first, then the toe part, sole part, heel part and ankle part in that order, and then continuously knitting the ankle part, heel part, sole part, toe part and finishing part belonging to the outer layer in succession, arranging the inner layer to be confronted with the outer layer, knitting the starting part of the inner layer together with the finishing part in the vicinity of the toe part of the outer layer to join the starting and finishing parts to thereby connect the inner and outer layers integrally, and finally suturing the inner and outer layers at the toe part of the outer layer to leave a single suturing line.

The above object is also achieved by a method for manufacturing a double sock with an inner and outer layers, each layer in its endless band form, comprising the steps of: first knitting the starting part corresponding to the uppermost tip of the toe part in the inner layer, causing the starting part to be hooked to an dial jack in the top plate of a sock knitting machine, continuously knitting the toe part, sole part, heel part and ankle part in that order, subsequently knitting the ankle part, heel part, sole part, toe part and finishing part belonging to the outer layer in succession, pulling the knitted product down an cylinder by air suction, so that the inner layer may be arranged to confront with the outer layer, the layers now in tube form, relative to the conjunction of the ankle part of the inner layer and the ankle part of the outer layer; knitting the starting part of the inner layer together with the finishing part in the vicinity of the toe part of the outer layer to join the starting and finishing parts to thereby connect the inner and outer layers integrally; and finally suturing the inner and outer layers at the open envelope position of the toe part of the outer layer so as to leave a single suturing line.

The double socks according to the invention are composed of the yarns, which yarns can induce the vaporization to emit to the outside the water vapor in the form of sweat so as to deprive a human body of the heat, for the purpose of good ventilation and humidity permeation, and which yarns are antibacteria-treated. Specifically, the inner and outer layers of the inventive double socks are mainly formed of hydrophilic fibers which are provided with long grooves extending along the fiber axes, through which grooves the water vapor can be transported. Thus, as these fibers, preferably polyester fiber, elastomer fiber, cotton fiber or wool fiber, which is provided with long longitudinal grooves, can be used singly or in combination of those two or more. The antibacteria-treated fibers are more preferred.

BRIEF DESCRIPTION OF THE INVENTION

Figure 2:
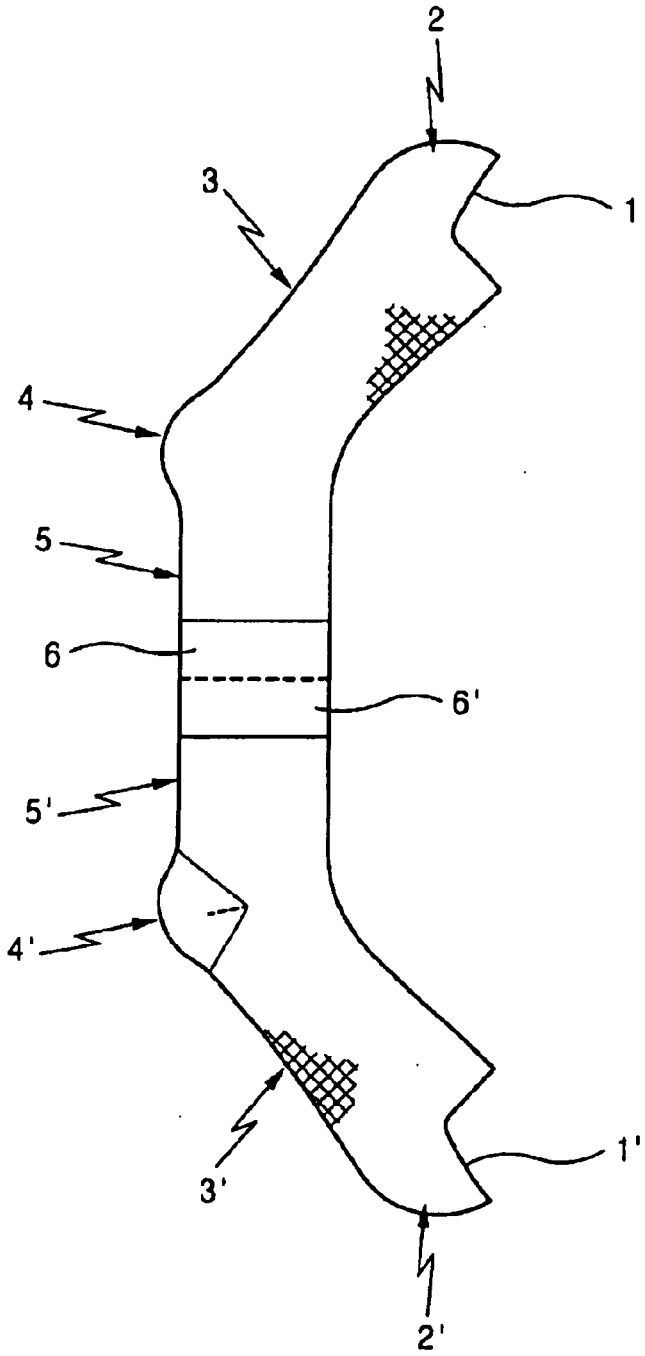
Figure 3A:
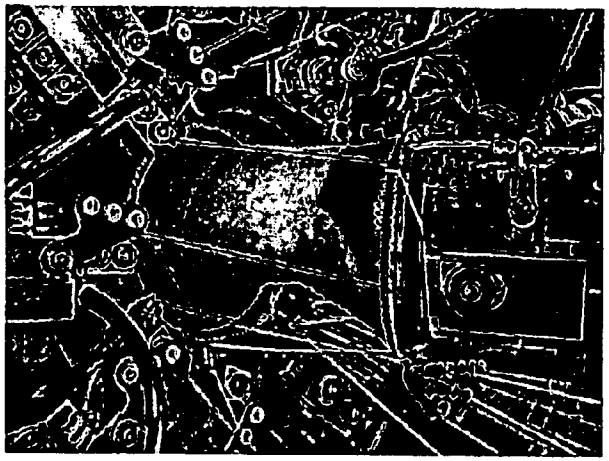
Figure 3B:
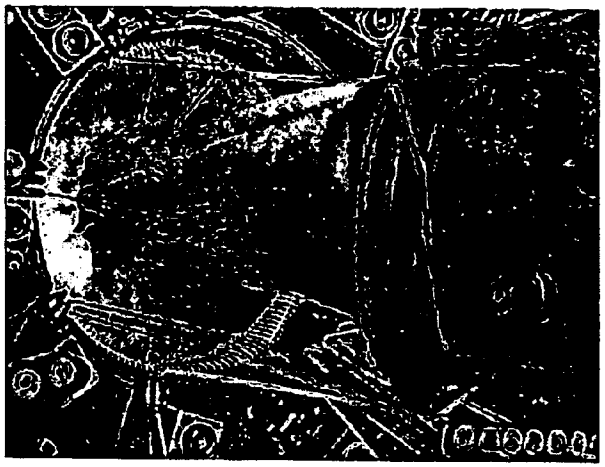
Figure 3C:
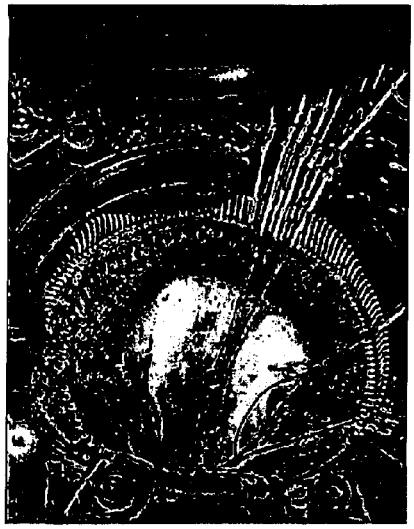
Figure 4:
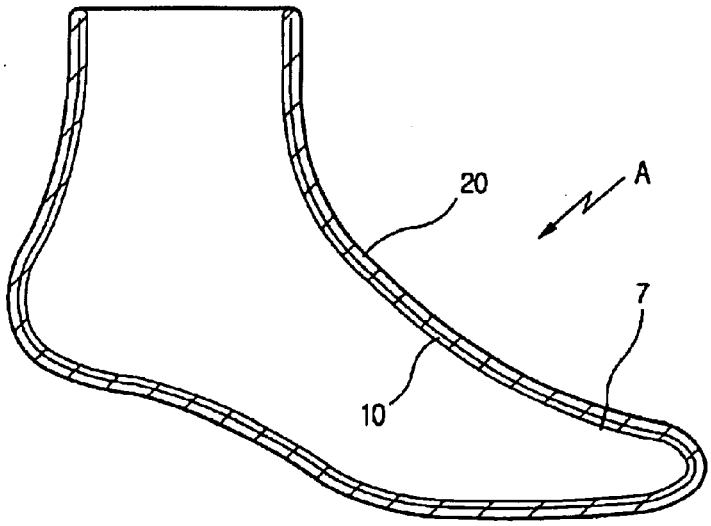

FIG. 1 shows the perspective view of the overall construction of a double sock according to the invention, FIG. 2 shows the developed view of a double sock according to the invention, FIG. 3 relates to the manufacturing steps for the double socks according to the invention, wherein FIG. 3*a* shows the photograph illustrating the process in which the toe part of an inner layer is successively knitted, as the starting part of the inner layer is gripped in the top plate dial jack of a sock knitting machine, FIG. 3*b* shows the photograph illustrating the process in which the knit ware is knitted in continuation to FIG. 3, as it is pulled down a cylinder, FIG. 3*c* shows the photograph illustrating the process in which the starting part of the inner layer is connected, by knitting, to the finishing part of the outer layer after the inner and outer layers are all knitted, and FIG. 4 shows the longitudinal sectional view of a double sock according to the invention.

DETAILED DESCRIPTION OF THE INVENTION

A preferred embodiment of the invention is described in detail below by referring to the accompanying drawings to manifest the characteristic features of the double-layered socks and the method for producing the same according to the invention.

First referring to FIG. 1, which shows the general schematic view of the double socks according to the invention, the inventive double sock A is seen to consist of two layers, that is, an inner layer 10 and an outer layer 20, each in an endless band form, wherein the layers are made of polyester fiber, cotton fiber or wool singly or in combination of two or more of them, and the fibers have long longitudinal grooves, so that the air ventilation may take place effectively in the external or outward direction and in the longitudinal direction based on the foot, to absorb the sweat instantly and expel the vapor to the outside, with the result that the heat conservation and cushioning effect can be provided to the feet, keeping the latter in a dry and clean condition.

The inventive double sock A as shown in FIG. 2 is composed of the inner layer 10 and the outer layer 20, wherein the inner layer 10, which will be positioned at the inner side of the finished sock, is knitted in the order of the toe part 2, sole part 3, heel part 4, ankle part 5, after the starting part 1 was knitted first, and subsequently in connection thereto, the outer layer 20 to be positioned externally are knitted in the order of the ankle part 5', heel part 4', sole part 3', toe part 2' and finishing part 1' in the reverse order of the case for the inner layer 10. Thus, the inner layer 10 and the outer layer 20 of the double sock A according to the invention are knitted in continuation to each other.

Depending on the situation, rubber piece parts 6, 6' can be additionally knitted on the top of the ankle parts 5, 5' of the inner and outer layers 10, 20, as indicated in FIG. 2, wherein the inner and outer layers 10 and 20 are integrally connected, so that their rubber piece parts 6 and 6' are in contact with each other.

After the double sock A is knitted overall as a whole, the starting part 1 knitted first in the toe part 2 of the inner layer 10 is arranged through a turn-over step to position at and knit together with the finishing part 1' near the toe part 2' of the outer layer 20 layed externally, as seen in FIG. 3*c*, whereby the two-layered sock of the inner and outer layers 10, 20 is continuously integrated, with the ankle parts 5, 5' or rubber piece parts 6, 6' serving as the turn-over junction.

Next, the double sock A is completed by suturing the opening portion left in the toe area 2' of the outer layer 20. Accordingly, a double sock A with double layers, in which the inner and outer layers 10 and 20 are integrally formed by only one single suturing line 7, can be obtained by the process according the invention, as shown in FIG. 4.

Specifically, in the manufacture of a double sock A according to the invention, as shown in FIG. 3*a*, the uppermost starting part 1 of the toe part 2 in the inner layer 10 is first knitted and then promptly hung and engaged in a dial jack of the top plate in a sock knitting machine, and under this condition, the toe part 2, sole part 3, heel part 4 and ankle part 5 are successively knitted. In connection to this, the ankle part 5', heel part 4', sole part 3', toe part 2' and finishing part 1', for the outer layer 20, are knitted in that order, so that two sheets of socks may continuously be knitted, with the ankle part 5 of the inner layer 10 joining with the corresponding ankle part 5' of the outer layer 20, wherein rubber piece parts 6, 6' can be added to the ankle parts 5, 5' of the inner and outer layers 10, 20, if the need be, as a matter of course. At this moment, as shown in FIG. 3*b*, the above-described knitted products are pulled down the interior of a cylinder by air suction, so that knitted layers can be in the tube form. Accordingly, a separate process as in the conventional case can be dispensed with, in which process the sock part of the inner layer 10 is pushed inside the outer layer 20 and the respective corresponding areas of the two sock sheets are adjusted to agree with each other. The process according to the invention leads to the state of the inner layer 10 included in the outer layer 20 via the turn-over step in the course.

Then, the starting part 1 of the inner layer 10 is knitted together with the finishing part 1' close to the toe part 2' of the outer layer 20, resulting in a double sock A with the inner and outer layers 10, 20 of two integrally joined sheets, as seen in FIG. 3*c*.

Thereafter, the opening in the finishing part 1' forming the tip of the toe part 2' of the outer layer 20 is closed by manual sewing, whereby there is obtained a double sock in which the inner and outer layers 10 and 20 are firmly connected by a single suturing line 7. Accordingly, the suturing line 7 is formed thinly and smoothly, resultantly imposing no hindrance on the movement of a foot in use.

As described in the above, the double socks according to the invention bring the effect of wearing two separate pairs of socks by wearing one pair of socks because of the dual layers, so that protection of feet particularly at the time of exercising and sufficient heat conservation during the winter season can be provided.

Whereas the double socks according to the invention are made of two layers, the suturing takes place only once at the toe parts of the outer layers, so that the suturing is made thinly, neatly and simply, because it is used to connect two adjacent single sheets. In addition, the commodity value is elevated, because fine hairs generated at the time of forming patterns on the socks are hidden by the inner layers of socks to make the inner surfaces of sock layers clean and neat. Further, the productivity can be raised due to remarkably reduced working hours and labors, because the process is omitted, in which the inner socks are pushed into the outer socks and the respective portions of the both socks are arranged or adjusted to correspond, as mentioned in the above.

What is claimed is:

1. A double sock with an inner and outer layers, each layer in its endless band form, the double sock (A) being formed by knitting the starting part (1) corresponding to the toe tip of the inner layer (10) at first, then the toe part (2), sole part (3), heel part (4) and ankle part (5) in that order, and then continuously knitting the ankle part (5'), heel part (4'), sole part (3'), toe part (2') and finishing part (1') belonging to the outer layer (20) in succession, arranging the inner layer (10) to be confronted with the outer layer (20), knitting the starting part (1) of the inner layer (10) together with the finishing part (1') in the vicinity of the toe part (2') of the outer layer (20) to join the starting and finishing parts to thereby connect the inner and outer layers (10, 20) integrally, and finally suturing the inner and outer layers (10, 20) at the toe part (2') of the outer layer (20) to leave a single suturing line (7).

2. A method for manufacturing a double sock with an inner and outer layers, each layer in its endless band form, comprising the steps of: first knitting the starting part (1) corresponding to the uppermost tip of the toe part (2) in the inner layer (10), causing the starting part (1) to be hooked to an dial jack in the top plate of a sock knitting machine, continuously knitting the toe part (2), sole part (3), heel part (4) and ankle part (5) in that order, subsequently knitting the ankle part (5'), heel part (4'), sole part (3'), toe part (2') and finishing part (1') belonging to the outer layer (20) in succession, pulling the knitted product down an cylinder by air suction, so that the inner layer (10) may be arranged to confront with the outer layer (20), the layers now in tube form, relative to the conjunction of the ankle part (5) of the inner layer (10) and the ankle part (5') of the outer layer (20);

knitting part (1) of the inner layer (10) together with the finishing part (1') in the vicinity of the toe part (2') of the outer layer (20) to join the starting and finishing parts to thereby connect the inner and outer layers (10, 20) integrally; and finally suturing the inner and outer layers (10, 20) at the open envelope position of the toe part (2') of the outer layer (20) so as to leave a single suturing line (7).

* * * * *